US008655574B2

(12) United States Patent
Izumoto et al.

(10) Patent No.: US 8,655,574 B2
(45) Date of Patent: Feb. 18, 2014

(54) IDLING STOP DEVICE, ENGINE START SYSTEM, AND ENGINE START METHOD

(75) Inventors: Ryoh Izumoto, Kobe (JP); Motoki Komiya, Kobe (JP); Yuuichiroh Shimizu, Kobe (JP); Yoshinori Shibachi, Kobe (JP)

(73) Assignee: Fujitsu Ten Limited, Kobe (JP)

( * ) Notice: Subject to any disclaimer, the term of this patent is extended or adjusted under 35 U.S.C. 154(b) by 511 days.

(21) Appl. No.: 13/047,171

(22) Filed: Mar. 14, 2011

(65) Prior Publication Data

US 2011/0224890 A1 Sep. 15, 2011

(30) Foreign Application Priority Data

Mar. 15, 2010 (JP) ..... 2010-056957

(51) Int. Cl.
*F02D 29/00* (2006.01)
*F02D 29/02* (2006.01)
*F02N 15/00* (2006.01)

(52) U.S. Cl.
USPC ..... 701/112

(58) Field of Classification Search
USPC ..... 701/112, 113; 123/179.3, 179.4, 123/198 DB; 307/10.6, 10.7, 10.1
See application file for complete search history.

(56) References Cited

U.S. PATENT DOCUMENTS 7,221,064 B2 * 5/2007 Okuda et al. ..... 307/10.1
7,830,126 B2 * 11/2010 Kawahara et al. ..... 320/160
2009/0314561 A1 * 12/2009 Handa ..... 180/65.25

FOREIGN PATENT DOCUMENTS

JP A 3-159528 7/1991
JP 2005207243 A * 8/2005 ..... F02D 29/02
JP 2005291158 A * 10/2005
JP A 2007-040229 2/2007
JP A 2009-013953 1/2009

* cited by examiner

*Primary Examiner* — Hieu T Vo
(74) *Attorney, Agent, or Firm* — Oliff PLC

(57) ABSTRACT

An idling stop device is mounted on a vehicle and automatically stops and starts an engine of the vehicle. A microcomputer has an idling stop function of automatically stopping the engine when a predetermined stop condition is established and automatically starting the engine when a predetermined start condition is established during the stopping of the engine. A detecting unit detects that a power voltage of the microcomputer, which is obtained by dropping a voltage of a battery of the vehicle is lower than a minimum operating voltage of the microcomputer. A storage unit stores voltage reduction information irrespective of a state of the microcomputer if the power voltage is lower than the minimum operating voltage. A power control unit causes a capacitor which stores electric charges corresponding to power for driving a starter motor of the engine to supply power to the starter motor when the engine is started, if the voltage reduction information is stored in the storage unit.

5 Claims, 6 Drawing Sheets

IDLING STOP DEVICE, ENGINE START SYSTEM, AND ENGINE START METHOD

The disclosure of Japanese Patent Applications No. 2010-056957 filed on Mar. 15, 2010, including specification, drawings and claims is incorporated herein by reference in its entirety.

BACKGROUND

The present invention relates to an idling stop technique for automatically stopping/starting an engine of a vehicle.

In recent years, from the viewpoint of reduction in fuel consumption, exhaust gas, or the like, an idling stop device has come into practical use which automatically stops/starts an engine of a vehicle when the vehicle is stopping for a comparatively short time, for example, at the time of waiting for a traffic signal to change. In a vehicle having an idling stop device, if a stop condition is established, for example, if a brake pedal is pressed in a traveling state and the vehicle is in a stop state, the engine is automatically stopped. When the engine is stopped, if a start condition is established, for example, if the brake pedal is released, the engine is automatically started (for example, see JP-A-2009-13953).

Power which drives a starter motor for starting the engine of the vehicle is supplied from a battery in the vehicle. Very large power is required when the starter motor starts the engine. For this reason, when the voltage of the battery is reduced, if the engine is repeatedly stopped and started through an idling stop function, the voltage of the battery is further reduced, causing a problem in that the engine may not be started. Thus, when the battery is deteriorated and the voltage of the battery is reduced, it is necessary to take a countermeasure which ensures that the engine can be started.

On the other hand, as described above, since very large power is required when the starter motor starts the engine, in starting the engine, the voltage of the battery is significantly reduced. For this reason, for example, a microcomputer in the idling stop device is configured to monitor the voltage of the battery when the engine is started by a user's manipulation of a start switch. When the voltage of the battery at this time is reduced less than a predetermined threshold value, in subsequently starting the engine through the idling stop function, the microcomputer is configured to carry out a countermeasure which ensures that the engine can be started.

However, since power for actuating the microcomputer is supplied from the battery, in starting the engine, when the voltage of the battery is significantly reduced less than a voltage at which the microcomputer is actuated, the microcomputer itself cannot be actuated and is reset. The microcomputer which has been reset and rebooted cannot recognize the reason for resetting or the voltage of the battery before resetting. The microcomputer is reset, for example, in a runaway state or the like, in addition to the reduction in voltage of the power supply, but the reason for resetting cannot be recognized.

For this reason, even when the voltage of the battery is significantly reduced and the microcomputer is reset, the microcomputer after resetting does not take a countermeasure which ensures that the engine can be started, but starts the engine through the idling stop function. As a result, the microcomputer may be again reset and the engine may not be started.

SUMMARY

It is therefore an object of at least one embodiment of the present invention to provide a technique for recognizing the reduction in voltage of the battery even after the microcomputer has been reset and ensuring that the engine can be started.

In order to achieve at least one of the above-described objects, according to a first aspect of the embodiments of the present invention, there is provided an idling stop device which is mounted on a vehicle and automatically stops and starts an engine of the vehicle, the idling stop device comprising: a microcomputer having an idling stop function of automatically stopping the engine when a predetermined stop condition is established and automatically starting the engine when a predetermined start condition is established during the stopping of the engine; a detecting unit that detects that a power voltage of the microcomputer, which is obtained by dropping a voltage of a battery of the vehicle is lower than a minimum operating voltage of the microcomputer; a storage unit that stores voltage reduction information irrespective of a state of the microcomputer if the power voltage is lower than the minimum operating voltage; and a power control unit that causes a capacitor which stores electric charges corresponding to power for driving a starter motor of the engine to supply power to the starter motor when the engine is started, if the voltage reduction information is stored in the storage unit.

With this configuration, when the power voltage of the microcomputer becomes lower than the minimum operating voltage of the microcomputer, even when the microcomputer is reset, the voltage reduction information is stored in the storage unit. For this reason, the microcomputer after resetting can recognize the reduction in voltage of the battery on the basis of the voltage reduction information. In subsequently starting the engine, power is supplied from the capacitor to the starter motor, such that the engine can be started with the power of the capacitor.

In the idling stop device, the power control unit may cause the battery not to supply power to the starter motor and cause the capacitor to supply power to the starter motor when the engine is started, if the voltage reduction information is stored in the storage unit.

With this configuration, when starting the engine, power is supplied from the capacitor to the starter motor while power is not supplied from the battery to the starter motor. Therefore, the engine can be started without affecting other electric loads to which power is supplied from the battery.

According to a second aspect of the embodiments of the present invention, there is provided an engine start system which is mounted on a vehicle and starts an engine of the vehicle, the engine start system comprising: a capacitor which stores electric charges corresponding to power for driving a starter motor of the engine; and the idling stop device as described above.

The engine start system may further comprises a boosting unit that boosts a voltage of a power line electrically connected to the battery of the vehicle and introduces the boosted voltage to the capacitor.

With this configuration, power can be stored in the capacitor with a comparatively high voltage. Therefore, a capacitor having comparatively small electric capacity can be used as the capacitor which stores power to the starter motor.

According to a third aspect of the embodiments of the present invention, there is provided an engine start method of starting an engine of a vehicle which is equipped with a microcomputer having an idling stop function of automatically stopping the engine when a predetermined stop condition is established and automatically starting the engine when a predetermined start condition is established during the stopping of the engine, the engine start method comprising: detecting that a power voltage of the microcomputer, which is obtained by dropping a voltage of a battery of the vehicle is lower than a minimum operating voltage of the microcomputer; storing voltage reduction information irrespective of a state of the microcomputer if the power voltage is lower than the minimum operating voltage; and supplying power from a capacitor which stores electric charges corresponding to power for driving a starter motor of the engine to the starter motor when the engine is started, if the voltage reduction information is stored in the storage unit.

DETAILED DESCRIPTION OF THE EMBODIMENTS

Hereinafter, embodiments of the invention will be described with reference to the drawings.

1. First Embodiment 1-1. Configuration

Figure 1:
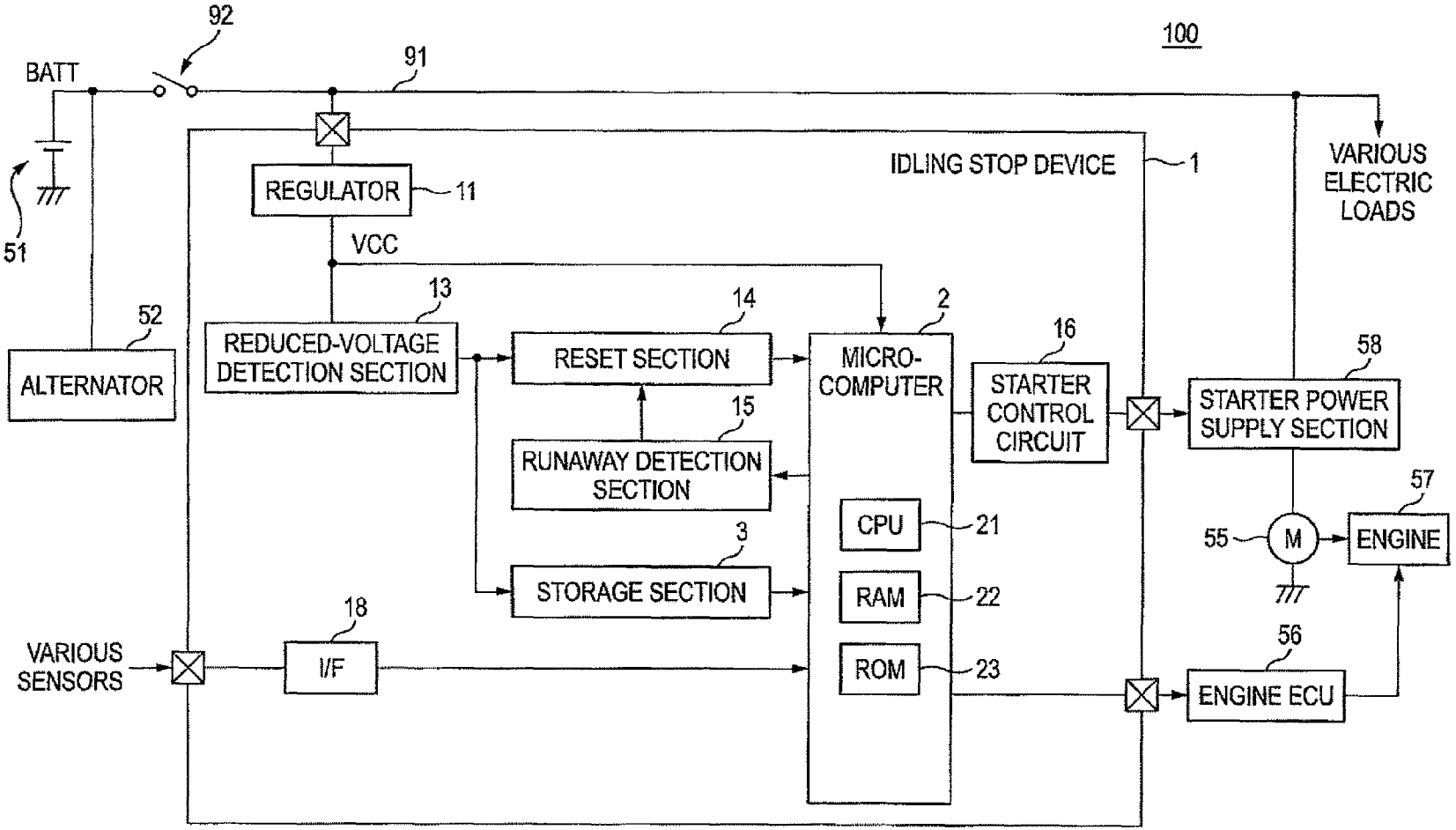
FIG. 1 is a block diagram illustrating the configuration of an engine start system.

FIG. 1 is a block diagram showing the configuration of an engine start system 100 including an idling stop device 1 of a first embodiment. The engine start system 100 is mounted on, for example, a vehicle, such as an automobile. The idling stop device 1 has a function of automatically stopping/starting an engine 57 in the vehicle when the vehicle is stopped for a comparatively short time, for example, at the time of waiting for a traffic signal to change.

The vehicle on which the engine start system 100 is mounted includes a battery 51 which supplies power to electric loads of the respective sections of the vehicle. A power line 91 is connected to the battery 51, and an ignition switch 92 which can be manipulated by a user is provided in the power line 91. If the ignition switch 92 is turned on, power is supplied from the battery 51 to the idling stop device 1 through the power line 91. If the ignition switch 92 is turned on, power is supplied from the battery 51 to various electric loads, which are mounted on the vehicle, through the power line 91.

The battery 51 is charged by an alternator 52 which is a power generator. The alternator 52 converts mechanical kinetic energy, which is transmitted from the engine 57, to alternating-current power and also rectifies alternating-current power to direct-current power by a rectifier including a diode. Generated power is accumulated in the battery 51 through the power line 91. When the alternator 52 generates power, a target voltage (for example, 14.5 V) which is targeted for power generation is set, and the alternator 52 generates power such that the voltage of the power line 91 becomes the target voltage.

The idling stop device 1 is constituted as an ECU (Electronic Control Unit) and includes a microcomputer 2 as a main constituent element. The microcomputer 2 includes a CPU 21, a RAM 22, and a ROM 23. Various functions of the microcomputer 2 are realized when the CPU 21 performs arithmetic processing in accordance with a program recorded in advance in the ROM 23. An idling stop function is included in the functions of the microcomputer 2. The idling stop function includes a starter driving function of driving a starter motor 55 in the vehicle.

The starter driving function is the function of driving the starter motor 55, which starts the engine 57 of the vehicle, to start the engine 57. The engine start system 100 includes a starter power supply section 58 which supplies power for driving the starter motor 55. The operation of the starter power supply section 58 is controlled by a starter control circuit 16 in the idling stop device 1. In starting the engine 57, the microcomputer 2 transmits a predetermined control signal to the starter control circuit 16. The starter control circuit 16 controls the operation of the starter power supply section 58 in response to the control signal.

Figure 2:
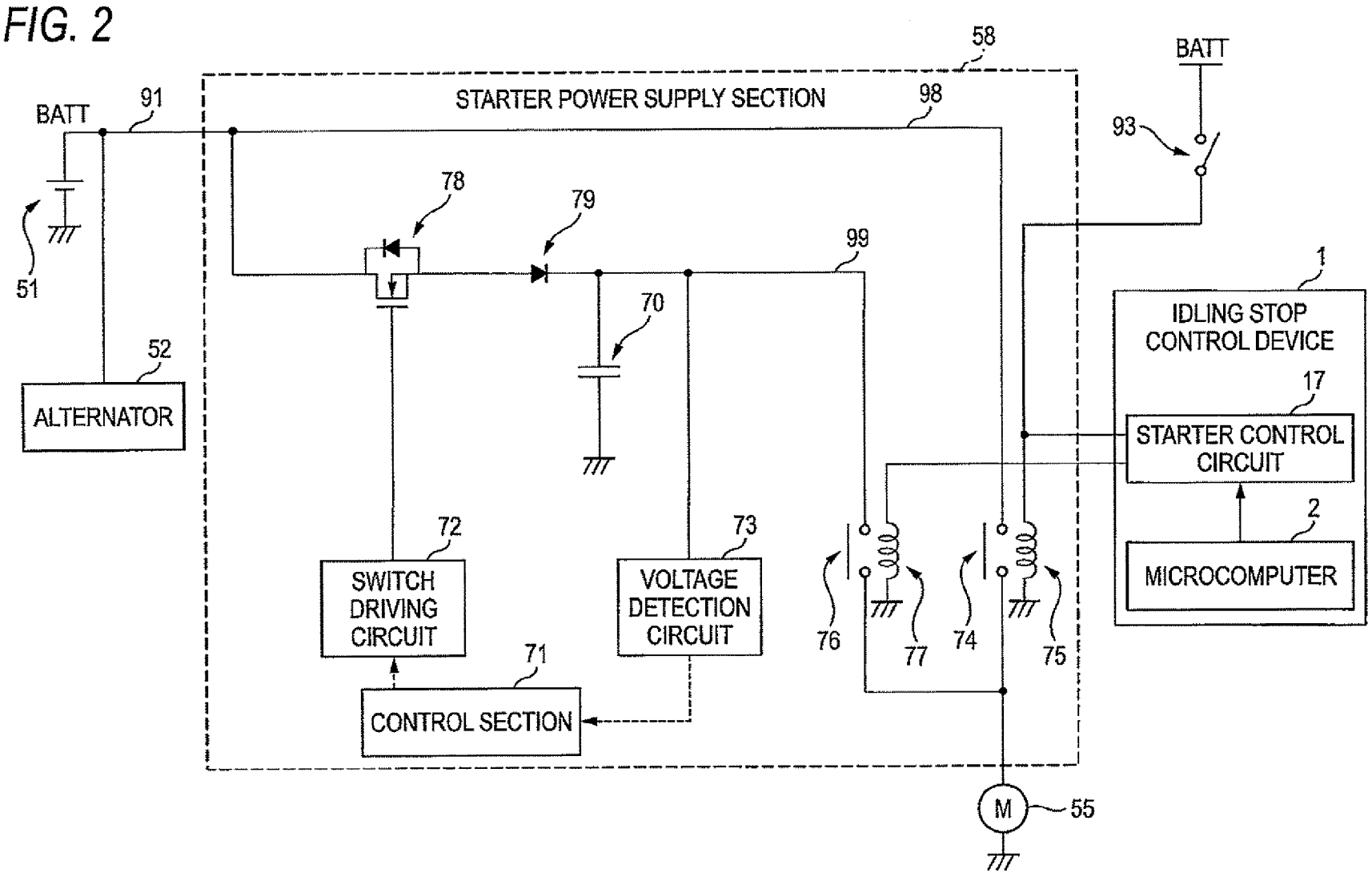
FIG. 2 is a diagram illustrating the configuration of a starter power supply section of a first embodiment.

FIG. 2 is a diagram showing the configuration of the starter power supply section 58 in detail. As shown in FIG. 2, the starter power supply, section 58 includes two supply lines which supply power to the starter motor 55, specifically, two supply lines of a first supply line 98 and a second supply line 99.

The upstream side of the first supply line 98 is connected directly to the power line 91 which is connected to the battery 51. For this reason, the voltage of the first supply line 98 is the same as the voltage of the power line 91. A relay switch 74 is provided on the downstream side of the first supply line 98. The relay switch 74 is turned on when electric conduction is provided to a corresponding relay coil 75.

A capacitor 70 is provided on the upstream side of the second supply line 99 to accumulate electric charges. One electrode (positive electrode) of the capacitor 70 is connected to the second supply line 99, and the other electrode (negative electrode) of the capacitor 70 is grounded. With regard to the capacitor 70, a capacitor, such as an electric double layer capacitor or a lithium-ion capacitor, is used in which a physical phenomenon, called an electric double layer, is used to obtain accumulation efficiency significantly higher than a general capacitor. With this structure, the capacitor 70 can accumulate electric charges corresponding to power necessary for driving the starter motor 55 to start the engine 57 once. A relay switch 76 is provided on the downstream side of the second supply line 99. The relay switch 76 is turned on when electric conduction is provided to a corresponding relay coil 77.

The starter control circuit 16 of the idling stop device 1 is configured to selectively provide electric conduction to the two relay coils 75 and 77. The idling stop device 1 provides electric conduction to one of the relay coils 75 and 77 to supply power to the starter motor 55, starting the engine 57. When electric conduction is provided to the relay coil 75 corresponding to the relay switch 74 of the first supply line 98, power can be supplied from the battery 51 to the starter motor 55. Meanwhile, when electric conduction is provided to the relay coil 77 corresponding to the relay switch 76 of the second supply line 99, power can be supplied from the capacitor 70 to the starter motor 55.

The capacitor 70 uses no chemical reaction compared to the battery 51 and has rapid responsiveness of charging and discharging and small internal resistance, such that charging and discharging are carried out with a large current. For this reason, the capacitor 70 is suitable for driving the starter motor 55 in which a large current is required in a comparatively short time.

When a start switch 93 which can be manipulated by the user is turned on, electric conduction may be provided to the relay coil 75 corresponding to the relay switch 74 of the first supply line 98. When the user gets in the vehicle, the starter motor 55 is driven in response to manipulation of the start switch 93, such that the engine 57 is started.

As a configuration for charging the capacitor 70, the starter power supply section 58 includes a MOSFET 78, a diode 79, a switch driving circuit 72, a voltage detection circuit 73, and a control section 71.

The diode 79 is provided to prevent flowback of a current from the capacitor 70 to the battery 51. The cathode of the diode 79 is connected to the positive electrode of the capacitor 70. The MOSFET 78 is provided between the diode 79 and the power line 91 and functions as a switch which switches the conduction state (on) and the non-conduction state (off) of a current flowing from the power line 91 to the capacitor 70. The MOSFET 78 is an N-channel type. The source of the MOSFET 78 is connected to the anode of the diode 79, and the drain of the MOSFET 78 is connected to the power line 91 through the first supply line 98.

The gate of the MOSFET 78 is connected to the switch driving circuit 72. The switch driving circuit 72 turns on the MOSFET 78 serving as a switch, such that the voltage of the power line 91 is applied to the capacitor 70 and the capacitor 70 is charged.

The voltage detection circuit 73 is connected to the second supply line 99 to detect the voltage of the second supply line 99, that is, the voltage (hereinafter, referred to as "capacitor voltage" of the positive electrode of the capacitor 70. The voltage detected by the voltage detection circuit 73 is input to the control section 71.

The control section 71 is constituted as a microcomputer including a CPU, a RAM, and a ROM. Various functions of the control section 71 are realized when the CPU performs arithmetic processing in accordance with a program recorded in advance in the ROM.

The control section 71 references the capacitor voltage input from the voltage detection circuit 73 and controls the operation of the MOSFET 78 such that the capacitor voltage is equal to or higher than a predetermined value. Specifically, when the capacitor voltage is reduced less than the predetermined value, the control section 71 transmits a signal to the switch driving circuit 72 to turn on the MOSFET 78, such that the capacitor 70 is charged. When the capacitor voltage is equal to or higher than the predetermined value, the control section 71 transmits a signal to the switch driving circuit 72 to turn off the MOSFET 78. When the vehicle is traveling, with power generation of the alternator 52, the voltage of the power line 91 is raised to the target voltage (for example, 14.5 V). The control section 71 uses the voltage of the power line 91 and controls the operation of the MOSFET 78 such that the capacitor voltage is maintained to be equal to or higher than a predetermined value (for example, 14 V).

The idling stop function of the microcomputer 2 is the function which automatically stops/starts the engine 57 of the vehicle in accordance with the traveling state of the vehicle. As shown in FIG. 1, signals representing the traveling state are input from various sensors in the vehicle to the microcomputer 2 through an interface 18. Specifically, the speed of the vehicle from a vehicle speed sensor, the position of a shift lever from a shift sensor, the manipulation content of an accelerator from an accelerator sensor, and the manipulation content of a brake pedal from a brake sensor are input as signals.

When a predetermined stop condition is established on the basis of the signals representing the traveling state, the engine 57 is stopped through the idling stop function. For example, when various conditions that "the speed of the vehicle is 0", "the position of the shift lever is "D" or "N"", "the accelerator is not manipulated", and "the brake pedal is manipulated" are all satisfied, it is determined that the stop condition is established.

In stopping the engine 57 through the idling stop function, the microcomputer 2 transmits a predetermined stop signal to an engine ECU 56 which controls the engine 57. The engine ECU 56 stops the engine 57 in response to the signal.

While the engine 57 is stopped through the idling stop function, when a predetermined start condition is established on the basis of the signals representing the traveling state, the engine 57 is automatically started through the idling stop function. For example, when various conditions that "the position of the shift lever is "D"", "the accelerator is manipulated", and "the brake pedal is not manipulated" are all satisfied, it is determined that the start condition is established.

In starting the engine 57 through the idling stop function, the microcomputer 2 drives the starter motor 55 through the starter driving function. At this time, power is supplied from the battery 51 to the starter motor 55 or power is supplied from the capacitor 70 to the starter motor 55. The details will be described below.

The idling stop device 1 includes a regulator 11, serving as a power supply circuit to the microcomputer 2, which drops an input voltage to a predetermined voltage. The regulator 11 is constituted, for example, in a combination of a switching regulator and a series regulator.

Although the power of the microcomputer 2 is supplied from the battery 51 of the vehicle, the ideal value of the voltage of the power supply of the microcomputer 2 is, for example, 5 V, and the normal voltage of the battery 51 is, for example, 12 V. For this reason, in the idling stop device 1, the voltage BATT of the battery 51 is dropped by the regulator 11 to obtain the voltage VCC of the power supply of the microcomputer 2.

The regulator 11 adjusts an output voltage in a range with an input voltage as an upper limit. If an input voltage is reduced less than a target voltage which has to be constant, the output voltage of the regulator 11 is also reduced less than the target voltage. Thus, when the battery 51 is deteriorated, if the voltage BATT of the battery is reduced, the voltage VCC of the power supply of the microcomputer 2 which is obtained through dropping in the regulator 11 is also reduced.

As a circuit for resetting the microcomputer 2, the idling stop device 1 includes a reduced-voltage detection section 13, a reset section 14, a runaway detection section 15.

The reduced-voltage detection section 13 is connected to a power supply line from the regulator 11 to the microcomputer 2, and monitors the voltage VCC of the power supply of the microcomputer 2. When the voltage VCC of the power supply of the microcomputer 2 has become less than the minimum operating voltage (hereinafter, denoted by the symbol "Vt") at which the microcomputer 2 is operable, the reduced-voltage detection section 13 outputs, to the reset section 14, an instruction signal indicating that resetting has to be done. The minimum operating voltage Vt of the microcomputer 2 is, for example, 3.9 V. The reduced-voltage detection section 13 is constituted by, for example, a comparator which compares the voltage VCC with the minimum operating voltage Vt.

The runaway detection section 15 detects whether or not the microcomputer 2 is in a runaway state, such as freezing. For example, the runaway detection section 15 monitors an operating signal of a watchdog timer of the microcomputer 2 and, when a regular signal is not detected, determines that the microcomputer 2 is in the runaway state. If the runaway state is reached, the microcomputer 2 cannot recover the functions until resetting is done. For this reason, the runaway detection section 15 outputs, to the reset section 14, an instruction signal indicating that resetting has to be done.

The reset section 14 outputs, to the microcomputer 2, a reset signal which instructs resetting. The reset signal is normally "H" and; if the reset signal becomes "L", an instruction to reset the microcomputer 2 is issued. If an instruction signal indicating that resetting has to be done is input from one of the reduced-voltage detection section 13 and the runaway detection section 15, the reset section 14 sets the reset signal to be "L". The microcomputer 2 constantly monitors the reset signal and, if the reset signal is "L", is reset. That is, the microcomputer 2 is temporarily stopped and rebooted.

The idling stop device 1 includes a storage section 3 which, when the voltage VCC of the power supply of the microcomputer 2 has become less than the minimum operating voltage Vt, stores information (hereinafter, referred to as "voltage reduction information") indicating that the voltage VCC has become less than the minimum operating voltage Vt. An instruction signal output from the reduced-voltage detection section 13 is also input to the storage section 3. That is, when the voltage VCC of the power supply of the microcomputer 2 has become less than the minimum operating voltage Vt, the indication is notified to the storage section 3 by the instruction signal, and the voltage reduction information is stored in the storage section 3 in response to the indication.

The storage section 3 is constituted by, for example, a flip-flop which is a logic circuit configured to store one-bit information. The minimum operating voltage of the storage section 3 is lower than the minimum operating voltage Vt (for example, 3.6 V) of the microcomputer 2 and is, for example, 1.6 V. That is, even when the power supply voltage of the storage section 3 is lower than the minimum operating voltage Vt of the microcomputer 2, the stored content can be retained. For this reason, the storage section 3 can store the voltage reduction information even when the microcomputer 2 is being reset, regardless of the state of the microcomputer 2.

If the voltage of the battery 51 is reduced and the voltage VCC has become less than the minimum operating voltage Vt, the microcomputer 2 is reset, but the voltage reduction information is stored in the storage section 3. From the indication that the voltage reduction information is stored in the storage section 3, the microcomputer 2 after resetting can recognize that the voltage VCC of the power supply before resetting has become less than the minimum operating voltage Vt.

1-2. Reset Processing

Figure 3:
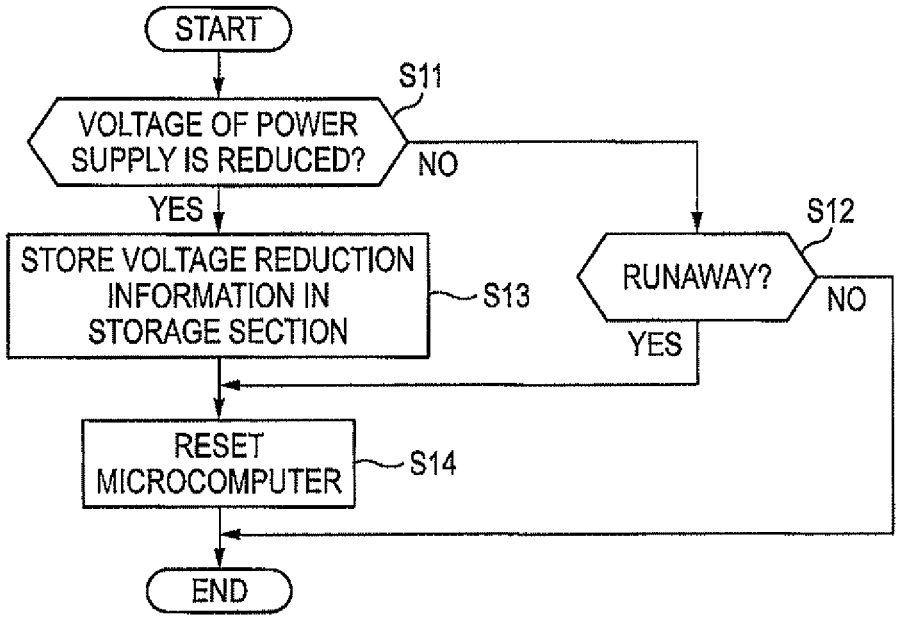
FIG. 3 is a diagram illustrating a flow of processing of an idling stop device when a microcomputer is reset.

The phenomenon that the voltage of the battery 51 is significantly reduced and the microcomputer 2 is reset occurs when the engine 57 is started because the starter motor 55 requires very large power. Hereinafter, in starting the engine 57 by a user's manipulation of the start switch 93, processing in the idling stop device 1 will be described. FIG. 3 is a diagram showing a flow of processing of the idling stop device 1. This processing starts immediately after the user gets in the vehicle. At this time, the idling stop device 1 is activated, but the engine 57 is not started.

First, while the engine 57 is being started, it is determined whether or not a condition that the microcomputer 2 has to be reset is established. Specifically, the reduced-voltage detection section 13 determines whether or not the voltage VCC of the power supply of the microcomputer 2 has become less than the minimum operating voltage Vt of the microcomputer 2 (Step S11). Simultaneously, the runaway detection section 15 determines whether or not the microcomputer 2 is in the runaway state (Step S12). When the voltage VCC is equal to or higher than the minimum operating voltage Vt (No in Step S11) and when the engine 57 is completely ignited (completely started) while the microcomputer 2 is not in the runaway state (No in Step S12), the processing ends.

When the voltage VCC of the power supply of the microcomputer 2 has become less than the minimum operating voltage Vt (Yes in Step S11), an instruction signal is output from the reduced-voltage detection section 13 to the reset section 14. The instruction signal is also input to the storage section 3, and the voltage reduction information is stored in the storage section 3 in response to the instruction signal (Step S13).

Meanwhile, when the microcomputer 2 has been in the runaway state (Yes in Step S12), an instruction signal is output from the reduced-voltage detection section 13 to the reset section 14.

If an instruction signal is input from one of the reduced-voltage detection section 13 and the runaway detection section 15, the reset section 14 sets the reset signal to be "L". The microcomputer 2 is reset in response to the indication that the reset signal is "L" (Step S14). When the voltage reduction information is stored in the storage section 3, the voltage reduction information stored in the storage section 3 is retained while the microcomputer 2 is being reset.

Thereafter, the microcomputer 2 is rebooted. The rebooted microcomputer 2 can recognize the reason for resetting on the basis of whether or not the voltage reduction information is stored in the storage section 3. That is, when the voltage reduction information is not stored in the storage section 3, it can be determined that resetting has been done because the runaway state has been reached. To the contrary, when the voltage reduction information has been stored in the storage section 3, it can be determined that resetting has been done because the voltage VCC has been less than the minimum operating voltage Vt.

Figure 4:
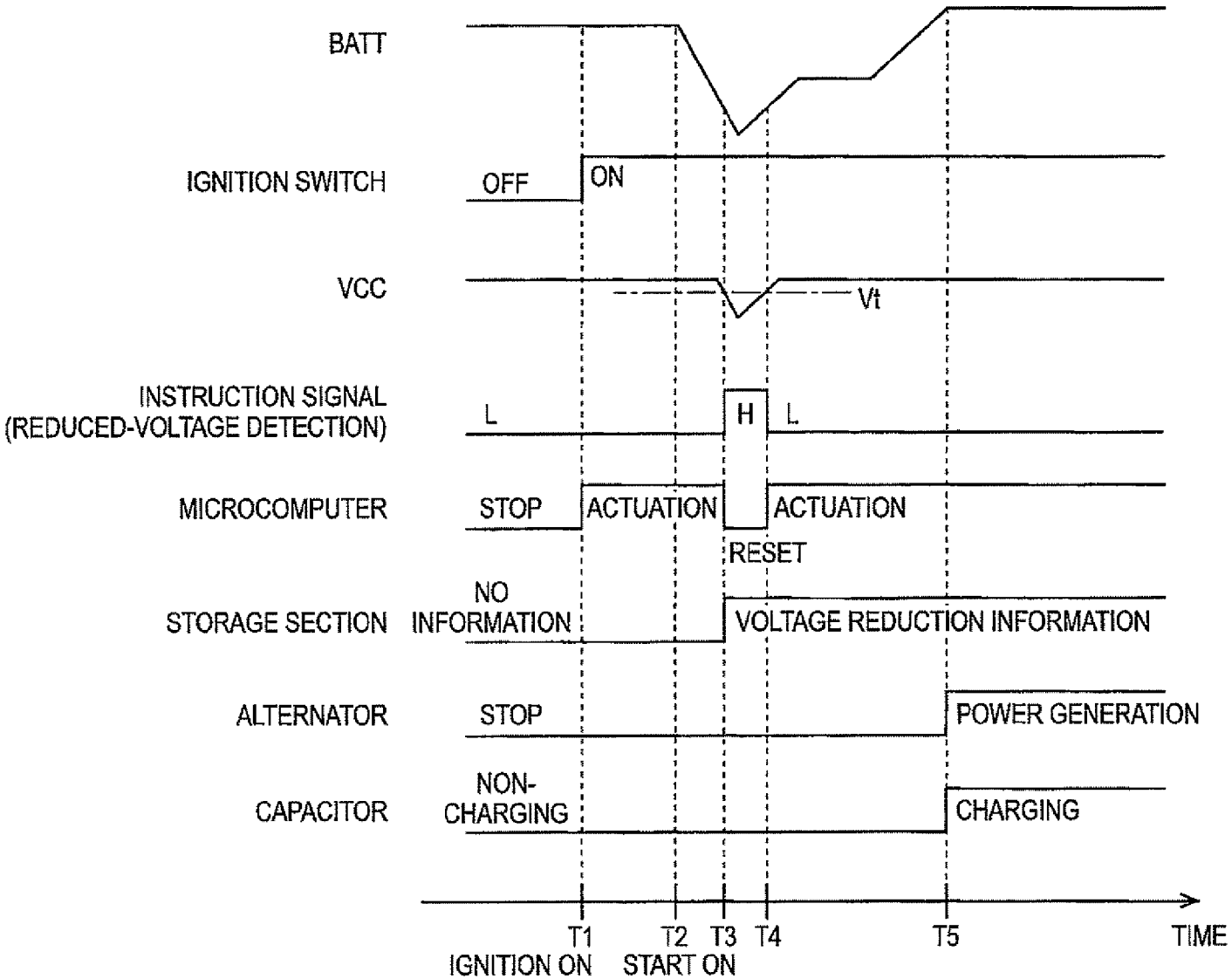
FIG. 4 is a diagram illustrating changes of various signals when a microcomputer is reset.

FIG. 4 is a time chart showing changes of various signals when the voltage of the battery 51 is reduced in starting the engine 57. At the time of the start of the chart, the ignition switch 92 is turned off and the engine 57 is not started.

First, at the time T1, the ignition switch 92 is turned on by a user's manipulation. Thus, power is supplied from the battery 51 to the idling stop device 1 and the microcomputer 2 is booted.

Next, at the time T2, the start switch 93 is turned on by a user's manipulation and the starter motor 55 is driven. With the driving of the starter motor 55, the voltage BATT of the battery 51 is reduced. Thus, the voltage of the power line 91 is reduced. When the battery 51 is deteriorated, the voltage VCC of the power supply of the microcomputer 2 is also reduced.

In this way, if the voltage VCC of the power supply of the microcomputer 2 is reduced and, at the time T3, becomes less than the minimum operating voltage Vt of the microcomputer 2, the reduced-voltage detection section 13 detects the situation and generates an instruction signal ("H"). When receiving the instruction signal, the reset section 14 sets the reset signal to be "L", and the microcomputer 2 is stopped for resetting. Simultaneously, the instruction signal from the reduced-voltage detection section 13 is also input to the storage section 3, and the voltage reduction information is stored in the storage section 3. Subsequently, the voltage reduction information is retained in the storage section 3, regardless of the state of the microcomputer 2.

Thereafter, if the load of the starter motor 55 decreases with the rotation of the engine 57, the voltage BATT of the battery 51 is gradually raised. For this reason, the voltage of the power line 91 or the voltage VCC of the power supply of the microcomputer 2 is also raised. If the voltage VCC of the power supply of the microcomputer 2 is raised and, at the time T4, becomes equal to or higher than the minimum operating voltage Vt of the microcomputer 2, the reduced-voltage detection section 13 stops the instruction signal ("L"). When receiving the instruction signal, the reset section 14 sets the reset signal to be "H", and the microcomputer 2 is rebooted. Thereafter, on the basis of the indication that the voltage reduction information is stored in the storage section 3, the rebooted microcomputer 2 can recognize that the battery 51 is deteriorated and the voltage of the battery 51 is reduced less than the normal value.

At the time T5, if the engine 57 is completely ignited, the starter motor 55 is stopped. Simultaneously, the alternator 52 starts to generate power. As described above, when the voltage reduction information is stored in the storage section 3, in a state where the alternator 52 generates power, the capacitor 70 is charged in the starter power supply section 58.

1-3. Idling Stop Processing

When the voltage reduction information is stored in the storage section 3, in order that the idling stop function can be maintained, the microcomputer 2 after resetting takes a countermeasure which ensures that the engine 57 can be started even when the battery 51 is deteriorated. Specifically, the microcomputer 2 causes power to be supplied from the capacitor 70, instead of the battery 51 which is deteriorated and reduced in voltage, to the starter motor 55. Hereinafter, this processing will be described.

Figure 5:
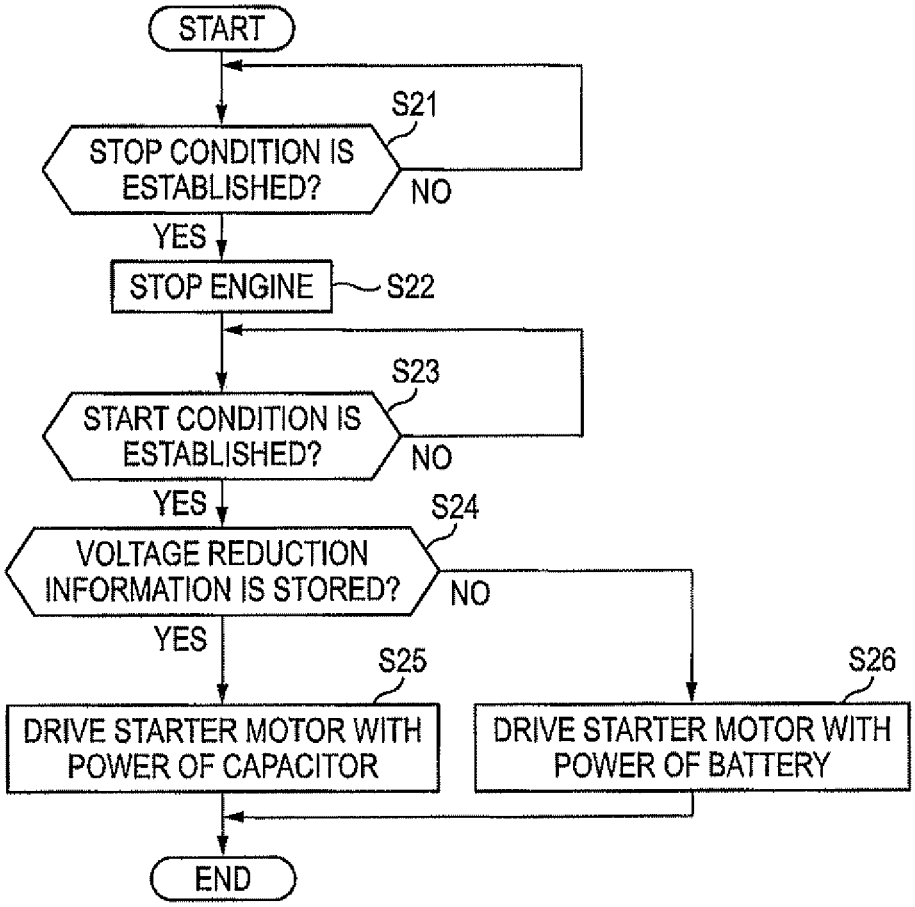
FIG. 5 is a diagram illustrating a flow of processing relating to an idling stop function of an idling stop device.

FIG. 5 is a diagram showing a flow of processing relating to the idling stop function of the idling stop device 1. It is assumed that, at the time of the start of the processing, the engine 57 is started.

First, the microcomputer 2 determines whether or not the stop condition is established on the basis of the input signals representing the traveling state (Step S21). When the stop condition is established, the microcomputer 2 transmits a stop signal to the engine ECU 56 to stop the engine 57 (Step S22).

Thereafter, the microcomputer 2 determines whether or not the start condition is established on the basis of the input signals representing the traveling state (Step S23). When the start condition is established, subsequently, the microcomputer 2 determines whether or not the voltage reduction information is stored in the storage section 3 (Step S24).

When the voltage reduction information is not stored in the storage section 3, the battery 51 is in the normal state. For this reason, the microcomputer 2 sends a signal to the starter control circuit 16 and turns on the relay switch 74 of the first supply line 98 of the starter power supply section 58. Thus, as in the normal state, power is supplied from the battery 51 to the starter motor 55, such that the starter motor 55 is driven to start the engine 57 (Step S26).

Meanwhile, when the voltage reduction information is stored in the storage section 3, the battery 51 is in a deteriorated state. For this reason, the microcomputer 2 sends a signal to the starter control circuit 16 and turns on the relay switch 76 of the second supply line 99 of the starter power supply section 58. Thus, power is supplied from the capacitor 70 to the starter motor 55, such that the starter motor 55 is driven to start the engine 57 (Step S25).

At this time, since the relay switch 74 of the first supply line 98 is turned off, power is not supplied from the battery 51 to the starter motor 55. Thus, in driving the starter motor 55, there is no case where various electric loads to which power is supplied from the battery 51 are affected. As a result, the occurrence of resetting of the microcomputer 2 can be prevented, and the engine 57 can be started.

As described above, in the idling stop device 1 of this embodiment, when the voltage of the battery 51 is reduced and the voltage VCC of the power supply of the microcomputer 2 has become less than the minimum operating voltage Vt of the microcomputer 2, the microcomputer 2 is reset. The voltage reduction information is stored in the storage section 3. For this reason, the microcomputer 2 after resetting can recognize the reduction in the voltage of the battery 51 on the basis of the voltage reduction information. Subsequently, in starting the engine 57, the microcomputer 2 causes power to be supplied from the capacitor 70 to the starter motor 55. Thus, even when the battery 51 is deteriorated, the engine 57 can be started with the power of the capacitor 70, and the idling stop function can be maintained.

In starting the engine 57, power is not supplied from the battery 51 to the starter motor 55, and power is supplied from only the capacitor 70 to the starter motor 55. Thus, there is no effect on the electric loads other than the starter motor 55 to which power is supplied from the battery 51, and the engine 57 can be started.

2. Second Embodiment

Next, a second embodiment will be described. The configuration and processing of an idling stop device 1 of the second embodiment are substantially the same as in the first embodiment. In the second embodiment, however, the starter power supply section 58 includes a boost circuit which boosts the voltage of the power line 91 connected to the battery 51 and introduces the boosted voltage to the capacitor 70.

Figure 6:
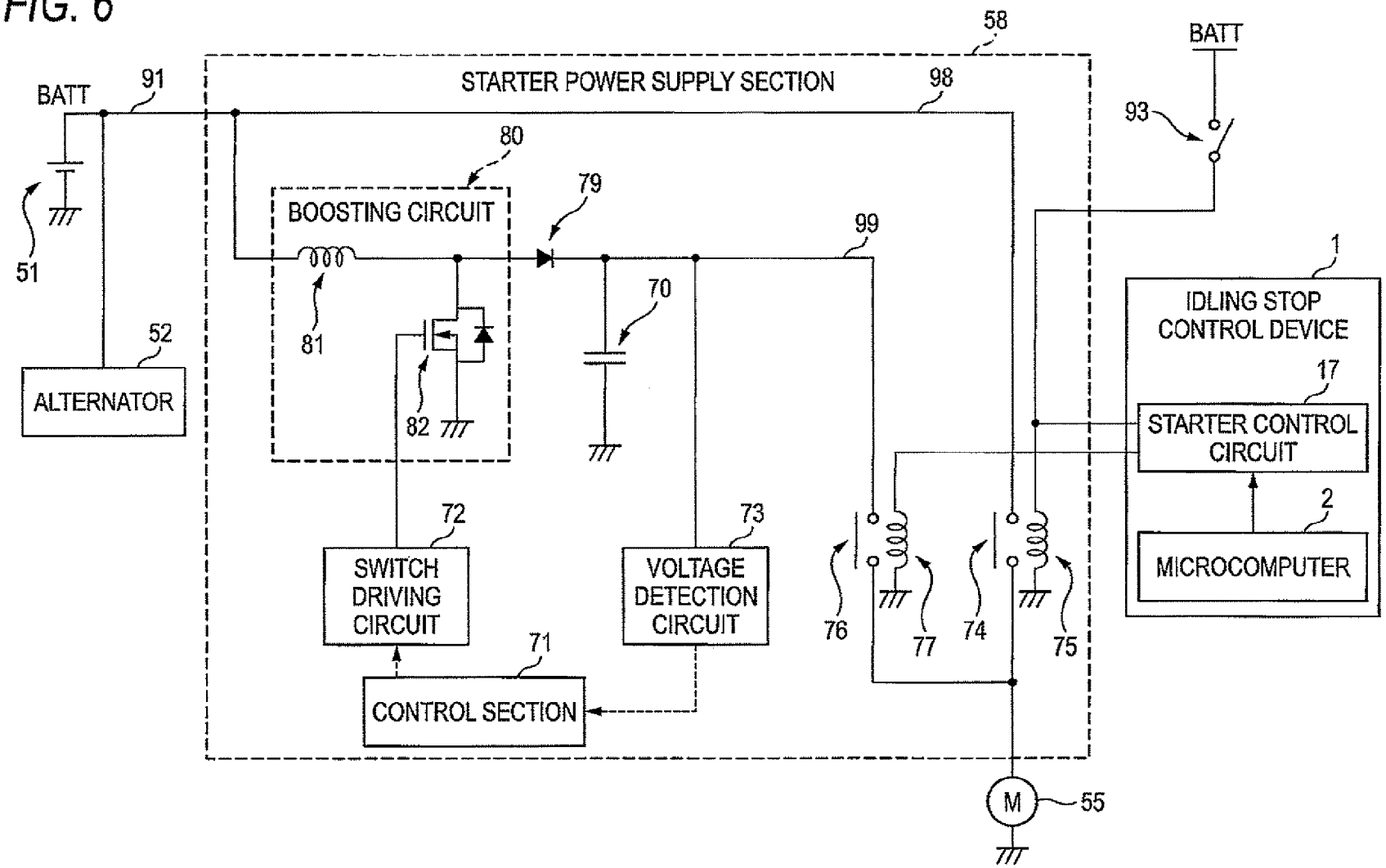
FIG. 6 is a diagram illustrating the configuration of a starter power supply section of a second embodiment.

FIG. 6 is a diagram showing the configuration of the starter power supply section 58 of the second embodiment. In the starter power supply section 58, a boost circuit 80 is provided instead of the MOSFET 78 shown in FIG. 2.

The boost circuit 80 includes a coil 81 and a MOSFET 82. One end of the coil 81 is connected to the power line 91 through the first supply line 98, and the other end of the coil 81 is connected to the anode of the diode 79. The drain of the MOSFET 82 is connected between the coil 81 and the diode 79, and the source of the MOSFET 82 is grounded.

The gate of the MOSFET 82 is connected to the switch driving circuit 72. The switch driving circuit 72 turns on/off the MOSFET 82 which serves as a switch, such that the voltage of the power line 91 is boosted and electric charges are accumulated in the capacitor 70 with the boosted voltage.

Specifically, if the MOSFET 82 is turned on, a current flows from the power line 91 toward the MOSFET 82. Then, a current flows in the coil 81 and energy is accumulated in the coil 81 in the form of magnetism. In this state, if the MOSFET 82 is turned off, energy accumulated in the coil 81 flows in the capacitor 70 as electric energy, and the capacitor 70 is charged. Thus, the MOSFET 82 is repeatedly turned on/off, such that electric charges are accumulated in the capacitor 70 with the boosted voltage. The degree of boosting in the boost circuit 80 can be adjusted depending on the on/off frequency of the MOSFET 82 and the duty ratio.

The control section 71 references the capacitor voltage which is input from the voltage detection circuit 73 and controls the boosting operation of the boost circuit 80 such that the capacitor voltage becomes a boosting target value (for example, 16 V). Specifically, the control section 71 determines the on/off frequency of the MOSFET 82 and the duty ratio and outputs a signal to the switch driving circuit 72 such that the MOSFET 82 is driven with the determined frequency and the duty ratio.

When the voltage reduction information is stored in the storage section 3, the boosting operation is carried out in a state where the alternator 52 generates power, and as a result, the capacitor 70 is charged with a comparatively high voltage. The method which causes power to be supplied from the capacitor 70 to the starter motor 55 is the same as in the first embodiment.

In the second embodiment, the boost circuit 80 is provided, such that the capacitor voltage can become higher than the voltage of the power line 91. That is, electric charges can be accumulated in the capacitor 70 with a voltage higher than the voltage of the battery 51 or the target voltage of the alternator 52. For this reason, as the capacitor 70 which accumulates electric charges corresponding to power necessary for driving the starter motor 55, a capacitor having comparatively small electric capacity can be used.

3. Modification

Although the embodiments of the invention have been described, the invention is not limited to the above-described embodiments and various modifications may be made. Hereinafter, the modifications will be described. All the forms including the forms described in the above-described embodiments and forms described below may be appropriately combined with each other.

In the above-described embodiments, when the voltage reduction information is stored in the storage section 3, in starting the engine 57, power is not supplied from the battery 51 to the starter motor 55, and power is supplied from only the capacitor 70 to the starter motor 55. In contrast, power may be supplied from both the battery 51 and the capacitor 70 to the starter motor 55. In this case, power of the capacitor 70 is used to drive the starter motor 55, preventing significant reduction in the voltage of the battery 51. For this reason, the occurrence of resetting of the microcomputer 2 can be prevented, and the engine 57 can be started. In this case, since electric charges which have to be accumulated in the capacitor 70 can be reduced, a capacitor having comparatively small electric capacity can be used.

In the second embodiment, in a state where the alternator 52 generates power (that is, in a state where the engine 57 is driven), the boosting operation is carried out to charge the capacitor 70. In contrast, when the voltage reduction information is stored in the storage section 3, after the engine 57 is stopped through the idling stop function, the boosting operation may be carried out to charge the capacitor 70. In this case, even when the voltage of the battery 51 is reduced, the capacitor 70 can be charged with a comparatively high voltage because of the boosting operation. Thus, the starter motor 55 can be driven to start the engine 57.

Although in the above-described embodiments, the idling stop device 1 and the starter power supply section 58 are provided separately, the idling stop device 1 and the starter power supply section 58 may be accommodated in the same housing as a single body and constituted as a single ECU (Electronic Control Unit). The microcomputer 2 of the idling stop device 1 may have the functions of the control section 71 of the starter power supply section 58 described above. Therefore, costs can be reduced.

The power supply voltage of the storage section 3 may be supplied directly from the battery 51, or a nonvolatile memory, such as an EEPROM or a flash memory, may be used as the storage section 3. In this case, the voltage reduction information can be stored in the storage section 3 regardless of the on/off of the ignition switch. For this reason, if the resetting of the microcomputer 2 due to reduction in voltage of the battery 51 occurs even once, the voltage reduction information stored in the storage section 3 is retained and subsequently, in starting the engine 57, power is supplied from the capacitor 70 to the starter motor 55. In this case, even when the engine 57 is started in response to a user's manipulation of the start switch 93, if the voltage reduction information is stored in the storage section 3, power may be supplied from the capacitor 70 to the starter motor 55. The voltage reduction information may be erased from the storage section 3 at the time of replacement of the battery 51.

Although in the above-described embodiments, the storage section 3 is constituted by a logic circuit which can store one-bit information, a memory having comparatively large storage capacity may be used. However, as in the above-described embodiments, if the storage section 3 is constituted by only a single logic circuit which can store one-bit information, the storage section 3 can be realized at very low cost.

Although in the above-described embodiments, a case has been described where various functions are realized in a software manner by the arithmetic processing of the CPU based on the program, a portion of the functions may be realized by an electrical hardware circuit. On the other hand, a portion of the functions which are realized by a hardware circuit may be realized in a software manner.

What is claimed is:

1. An idling stop device which is mounted on a vehicle and automatically stops and starts an engine of the vehicle, the idling stop device comprising:

a microcomputer having an idling stop function of automatically stopping the engine when a predetermined stop condition is established and automatically starting the engine when a predetermined start condition is established during the stopping of the engine;

a detecting unit that detects that a power voltage of the microcomputer, which is obtained by dropping a voltage of a battery of the vehicle is lower than a minimum operating voltage of the microcomputer;

a storage unit that stores voltage reduction information irrespective of a state of the microcomputer if the power voltage is lower than the minimum operating voltage; and a power control unit that causes a capacitor which stores electric charges corresponding to power for driving a starter motor of the engine to supply power to the starter motor when the engine is started, if the voltage reduction information is stored in the storage unit.

2. The idling stop device as set forth in claim 1, wherein the power control unit causes the battery not to supply power to the starter motor and causes the capacitor to supply power to the starter motor when the engine is started, if the voltage reduction information is stored in the storage unit.

3. An engine start system which is mounted on a vehicle and starts an engine of the vehicle, the engine start system comprising:

a capacitor which stores electric charges corresponding to power for driving a starter motor of the engine; and the idling stop device as set forth in claim 1.

4. The engine start system as set forth in claim 3, further comprising a boosting unit that boosts a voltage of a power line electrically connected to the battery of the vehicle and introduces the boosted voltage to the capacitor.

5. An engine start method of starting an engine of a vehicle which is equipped with a microcomputer having an idling stop function of automatically stopping the engine when a predetermined stop condition is established and automatically starting the engine when a predetermined start condition is established during the stopping of the engine, the engine start method comprising:

detecting that a power voltage of the microcomputer, which is obtained by dropping a voltage of a battery of the vehicle is lower than a minimum operating voltage of the microcomputer;

storing voltage reduction information irrespective of a state of the microcomputer if the power voltage is lower than the minimum operating voltage; and supplying power from a capacitor which stores electric charges corresponding to power for driving a starter motor of the engine to the starter motor when the engine is started, if the voltage reduction information is stored in the storage unit.

* * * * *